United States Patent [19]

Kozyrski et al.

[11] Patent Number: 4,798,112

[45] Date of Patent: Jan. 17, 1989

[54] HEAD ASSEMBLY FOR MAT CUTTING MACHINE

[75] Inventors: Vincent T. Kozyrski, Plainville; Alan R. Peters, Milford, both of Conn.

[73] Assignee: The Fletcher-Terry Company, Farmington, Conn.

[21] Appl. No.: 123,397

[22] Filed: Nov. 20, 1987

Related U.S. Application Data

[63] Continuation-in-part of Ser. No. 13,578, Feb. 11, 1987.

[51] Int. Cl.[4] ..... B26D 7/26

[52] U.S. Cl. ..... 83/455; 83/522; 83/564; 83/581; 83/614

[58] Field of Search ..... 83/455, 614, 468, 635, 83/829, 522, 620, 564, 527, 581

[56] References Cited

U.S. PATENT DOCUMENTS

| | | | |
|---|---|---|---|
| 1,897,534 | 2/1933 | Simpson | 83/454 |
| 2,835,037 | 5/1958 | Middents | 83/614 X |
| 3,918,337 | 11/1975 | Lindblad et al. | 83/409 |
| 4,036,484 | 7/1977 | Molpus | 269/303 |
| 4,570,516 | 2/1986 | Bruns | 83/455 |
| 4,590,834 | 5/1986 | Sobel | 83/455 |

*Primary Examiner*—Donald R. Schran
*Attorney, Agent, or Firm*—Ira S. Dorman

[57] ABSTRACT

A mat cutting machine utilizes a trolley, which runs smoothly and stably along a shaft mounted upon the clamping bar assembly, the head assembly of the trolley including eccentric means for precisely adjusting the relationship between the cutting blade on the bevel side and the edge of the clamping bar.

19 Claims, 2 Drawing Sheets

HEAD ASSEMBLY FOR MAT CUTTING MACHINE

CROSS REFERENCE TO RELATED APPLICATION

This application is a continuation-in-part of copending application Ser. No. 07/013,578, filed on Feb. 11, 1987.

BACKGROUND OF THE INVENTION

Hand-operated machines for cutting mat board used in picture framing are well known in the art. Generally, such machines include a base, to which may be mounted a clamping bar for holding the mat board in position thereupon during the cutting operation. In some forms, the clamping bar will have a shaft or rail supported upon it, which in turn serves to guide a cutting head or trolley across the workpiece. Since, in the usual case, the sight opening for the framed picture will be defined by beveled edges, the cutting heads have often been provided with holders for two blades, one holder being disposed to position a blade to cut perpendicularly with respect to the supporting surface, the other being disposed to position a second blade at an acute angle (typically, about 55 degrees) thereto.

The patent art with respect to machines and devices for cutting mat board and similar workpieces is quite voluminous. A fair representation thereof is believed to be constituted by the following United States Patents: Smith U.S. Pat. No. 228,686; Gaylord No. 491,307; Wheeler No. 513,851; McCall No. 570,180; Drinkaus No. 611,238; Gaffney No. 1,235,459; Williams No. 1,250,538; Buckingham No. 1,529,340; Simpson No. 1,897,534; Matthews 2,013,893; Smith 2,065,761; Tourneau No. 2,342,946; Carpenter No. 2,413,544; Schlitters No. 2,449,327; Pulsifer No. 2,581,602; Zelewsky No. 3,095,247; Eno No. 3,130,622; Shapiro No. 3,463,041; Ellerin No. 3,527,131; Hearns No. 3,543,627; Rogers No. 3,628,412; Decker No. 3,702,716; Rosetti No. 3,712,166; McBride No. 3,768,357; Martin No. 3,897,706; Kupersmith No. 3,903,767; Chaffin No. 3,953,086; Schwartz No. 3,964,360; Stowe No. 3,973,459; Logan No. 3,996,827; Jones No. 4,022,095; Meshulam No. 4,064,626; Ward No. 4,096,631; Larson No. 4,202,233; Rempel No. 4,413,542; Gelfand No. 4,440,055; Davis No. 4,503,612; Heathe No. 4,518,205; Bruns No. 4,570,516; and Sobel No. 4,590,834.

The patents to Simpson, Lanblad et al and Bruno are of some specific interest to the instant invention. Simpson provides apparatus having a cutter carriage, on which is mounted a presser wheel carried by an adjustable guide bar. The device of the Linblad et al patent employs a cutting assembly having guide wheels adjustably mounted on its opposite sides, which ride upon a track provided by parallel rail members. Bruno discloses a cutter-carrying body having a plurality of slippery polymeric wear buttons which project from its bottom surface, at least one of the buttons being adjustable to vary the extent of its projection.

Despite the activity indicated by the foregoing, the need remains for a head assembly for a mat cutting machine which is capable of smooth and reliable operation, to produce accurate and precisely located cuts on the workpiece, and it is therefore the broad object of the present invention to provide a novel head assembly having those capabilities, as well a novel mat cutting machine in which it is incorporated.

It is a related object of the invention to provide such a cutting head in which the position of the blade for bevel cutting can readily be adjusted, without removal from the machine, and while also being securely maintained once established.

Another related object is to provide such a novel machine, in which the adjustment of the bevel-cutting blade is readily made with respect to the clamping bar.

SUMMARY OF THE INVENTION

It has now been found that certain of the foregoing and related objects of the invention are attained by the provision of a head assembly for a mat cutting machine, which includes a body having a bottom surface with at least one planar area thereon, a rectilinear channel extending from end-to-end through the body and opening on the bottom surface along the entire length thereof, and a first surface portion along one side of the body which is disposed at an acute angle to the planar area and which extends substantially parallel to the axis of the channel. The head assembly also includes a first wheel subassembly comprised of a first wheel and first means for mounting it on the body for rotation about an axis perpendicular to the channel axis, and with at least a rim portion of extending beyond the bottom surface at a location adjacent the one side of the body. The first mounting means includes an axle member mounted for pivoting on an axis perpendicular to the channel axis, and locking means for securing the axle member in each of a multiplicity of angularly displaced positions pivoted on the axis of pivoting. A support portion of the axle member supports the first wheel for rotation about an eccentric axis parallel to the axis of pivoting and offset from it, so that the amount of extension of the wheel rim portion can be varied by pivoting of the axle member, and it as well as the locking means are so disposed on the body as to permit ready access, for convenient manipulation. The head assembly also includes contact means disposed at a location spaced to the opposite side of the channel opening from the "one" side of the body, which serves to engage the underlying structure and thereby to support the body for slidable movement therealong.

In a preferred embodiment, the contact means will be provided by a second wheel subassembly, including a second wheel, and second means for mounting the second wheel on the body for rotation about an axis perpendicular to the channel axis. At least the rim portion of the second wheel will extend beyond the bottom surface of the body, at a location spaced to the opposite side of the channel opening from the "one" side, and the second mounting means will be adapted to permit variation of the amount of extension. The second mounting means may comprise a pivot arm pivotably supported upon the body and mounting the second wheel at a location spaced from the axis of pivotable support. An adjustment element will desirably be in effective engagement with the pivot arm, for varying the angular orientation thereof about the support axis and thereby the amount of extension of the wheel rim portion.

In especially preferred embodiments, the axle member of the first wheel subassembly will comprise an eccentric stud having a cylindrical shaft portion and a cylindrical collar portion adjacent one end of the shaft portion, with the axes of the shaft and collar portions being parallel to and offset from one another, and with the collar portion providing support for the wheel. The stud will normally have tool-engaging means, accessible to permit facile pivoting, and the first wheel (and the second, when employed) will desirably consist of a ball bearing, the outer ring component of which will provide the contacting rim portion. Most desirably, the shaft portion of the stud will have a groove extending circumferentially about it at a location spaced from the "one" end, and the locking means will comprise a screw. In that case, the body will have an aperture in which the screw is threadably engaged, and a tip portion of the screw will engage within the groove of the shaft portion, to enable the stud to be fixed against pivoting in the body.

The body of the head assembly will advantageously be formed with a shoulder portion, on which adjacent faces are disposed substantially perpendicular to one another. The shaft portion of the eccentric stud will extend normal to one of the faces and the screw will extend normal to the other one, on which the threaded aperture will also open.

In particularly preferred embodiments, the head assembly will additionally include a pair of bushing elements, fabricated from a low-friction bearing material (advantageously, a synthetic resinous material) and disposed within the body channel adjacent its ends, to provide spaced bearing surfaces. The body may have means overlying the bushing elements to permit clearance adjustments to be made, and the bushing elements will desirably be of a ring-like structure; the clearance-adjustment means may serve to apply upward force upon the body, to thereby tighten it against the bushing elements and, in turn, a mounting rail. The head assembly will normally include blade mounting means on the "first" surface portion, with such means being adapted to mount a cutting blade in a plane substantially parallel to the surface portion and outwardly of the "first" wheel.

Other objects of the invention are attained by the provision of a novel mat cutting machine, utilizing a head assembly having the features described. The machine will also include, in combination with the head assembly, a base having an upper, mat-supporting surface, a handle assembly pivotably mounted upon the base for movement between a position overlying the mat-supporting surface and a position displaced from it, and a clamping bar assembly pivotably mounted by the handle assembly and including an elongated clamping bar and a substantially coextensive guide rail. The clamping bar has substantially planar top and bottom surface portions extending along its length and, in the overlying position of the handle assembly, is adapted to rest with its bottom surface upon the upper surface of the base. The guide rail is affixed on top of the clamping bar, and slidably mounts the cutting head assembly for movement therealong.

DETAILED DESCRIPTION OF THE ILLUSTRATED EMBODIMENTS

Figure 1:
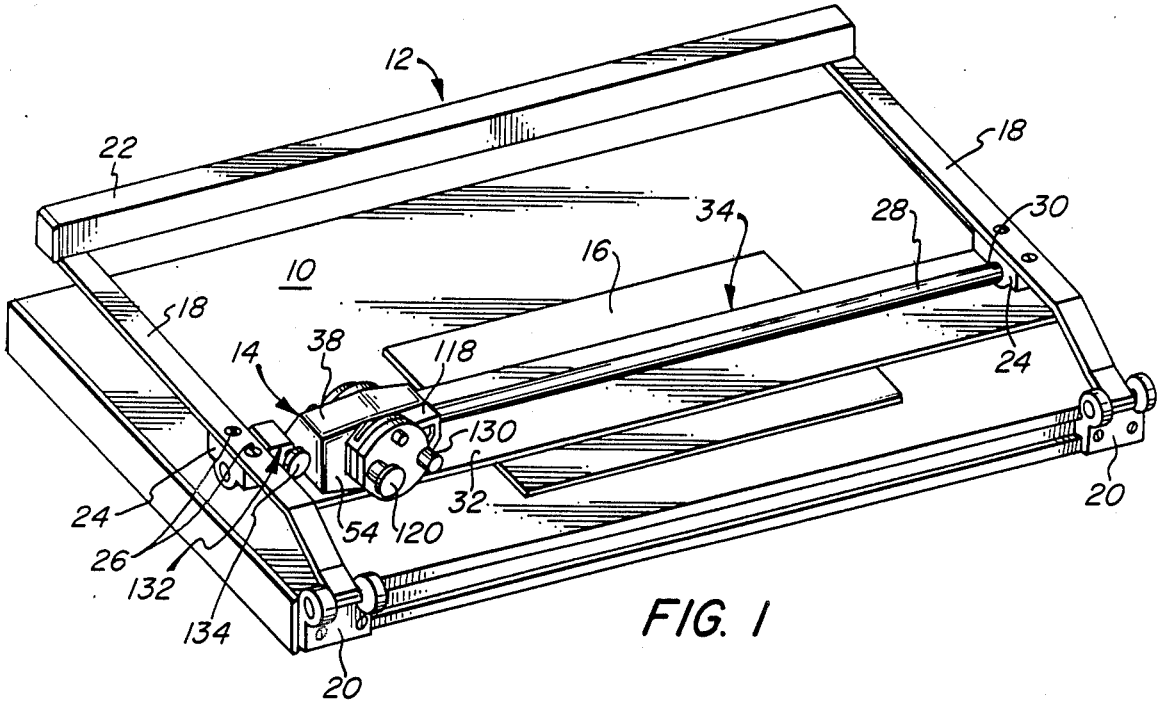
FIG. 1 is a perspective view of a mat cutting machine embodying the present invention.
Figure 2:
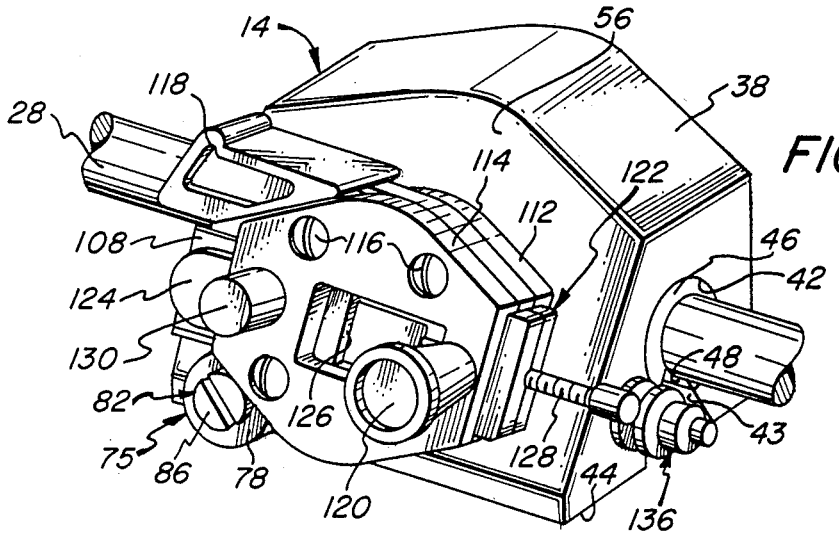
FIG. 2 is a perspective view of a trolley utilizing the cutting head assembly of the invention, and employed in the machine of FIG. 1.
Figure 4:
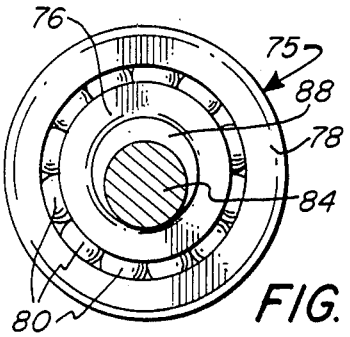
FIG. 4 is a view of the subassembly of FIG. 3, taken along line 4—4 thereof.
Figure 3:
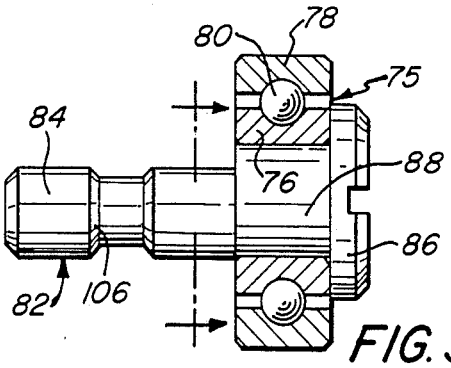
FIG. 3 is an elevational view, in partial section, showing an adjustable wheel subassembly employed in the head assembly of FIG. 2, and drawn to a scale enlarged therefrom.

Turning now more specifically to the appended drawings, FIG. 1 shows a mat cutting machine embodying the present invention. It consists of a base, generally designated by the numeral 10, a handle assembly generally designated by the numeral 12, and a trolley, including a head assembly generally designated by the numeral 14; a piece of mat board 16 is positioned on the upper surface of the base 10.

Figure 5:
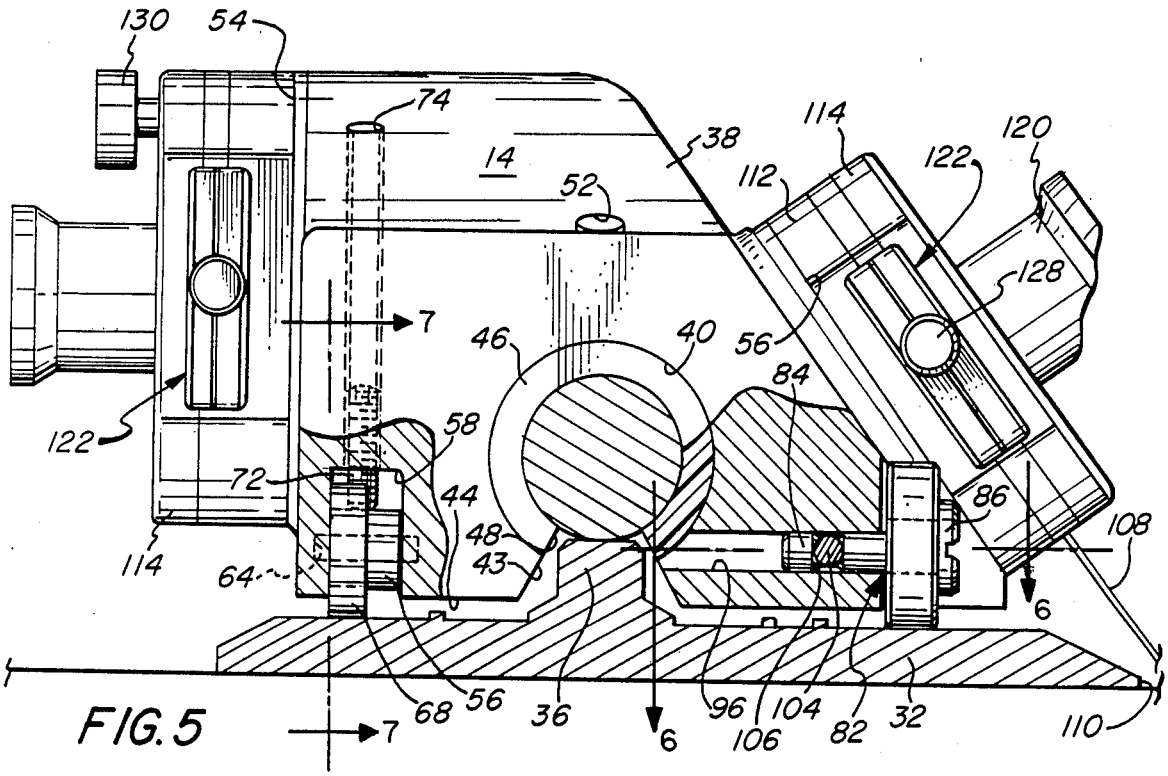
FIG. 5 is an end view of the trolley of the foregoing Figures, with portions broken away and with supporting components of the mat cutting machine shown in section.
Figure 6:
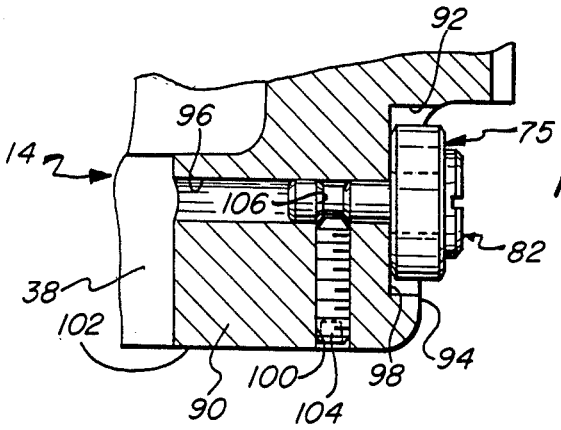
FIG. 6 is a fragmentary view of the cutting head assembly, taken generally along line 6—6 of FIG. 5 and drawn to the scale thereof, with portions of the body shown in section.
Figure 7:
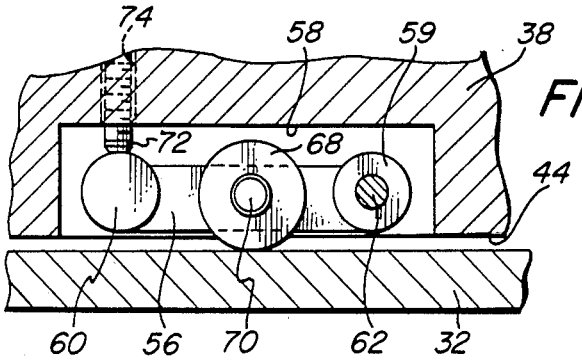
FIG. 7 is a view similar to that of FIG. 6, showing the second wheel subassembly and taken along line 7—7 of FIG. 5.

The arms 18 of the handle assembly 12 are mounted by hinges 20 on the base 10; they in turn support an elongated tubular handle 22 at their free ends, and a journal block 24 is mounted at an intermediate position on each arm 18, by use of fasteners 26. The opposite ends of a guide rail 28 are pivotably received and secured within circular sockets 30, formed into the blocks 24, and the body 32 of a clamping bar, generally designated by the numeral 34, is affixed to the rail 28 by a series of screws (not seen), the rail being disposed upon a coextensive rib portion 36 (FIG. 5) of the clamping bar body 32. Because the ends of the rail 28 are journaled within the blocks 24, it will be appreciated that the clamping bar 34 is pivotably mounted between the arms 18, enabling it to adjust automatically to workpieces of varying thicknesses, and to lie flat thereupon.

The trolley of the machine is slidably mounted upon the rail 28 for movement between the arms 18. For that purpose, the body 38 of the head assembly 14 is formed with an end-to-end channel (only the opposite ends, 40, 42 of which can be seen), which opens at 43 through the bottom surface 44 along its entire length; circular seats are defined at the ends 40, 42 of the channel, and a plastic (e.g., Delrin) bushing 46 is seated in each. The bushings 46 are of generally circular cross section, interrupted by a gap 48 extending axially along the bottom; they are interposed between the rail 28 and the body 38 of the head assembly, and each bushing is affixed in position by a set screw (not seen), which is engaged within a threaded bore 52 of the body. The screws serve not only to maintain the bushings 46 in a proper orientation, with the slots 48 aligned with the opening 43 of the body channel, but they can also be adjusted to take up clearance between the body 38, the bushings 42, and the rail 28. It will of course be evident that the slots 48, like the channel opening 43 through the body 38, are necessary to permit passage of the elongated rib portion 36 on the clamping bar 34, so that the trolley can move along the rail 28.

The body 38 of the head assembly is formed with planar surfaces 54, 56 along its opposite sides, surface 54 being perpendicular to the bottom surface 44 and surface 56 forming an acute angle of about 55 degrees therewith. Both surfaces 54, 56 will also be substantially parallel to the axis of the rail 28, although it is conventional to deviate slightly (e.g., by about 2°) therefrom on the bevel side, so as to avoid "hooking" at the point of initiation of the cut produced.

An elongated slot 58 is formed into the body 38, upwardly from the bottom surface 44 adjacent the perpendicular surface 54, and it extends longitudinally and parallel to the channel therethrough. A pivot arm 56 is disposed within the slot 58, and has a hub portion 59 at one end and a circular contact portion 60 at the other. A pivot pin 62 extends through a transverse aperture in the hub portion 59, and has its opposite ends engaged within aligned bore portions 64 formed into the body, thus serving to pivotably mount the arm 56.

Intermediate its ends, the arm 56 carries a ball bearing subassembly, including a contact wheel 68 and an axle 70. As can be seen, the wheel 68 is of sufficient diameter to project beyond the lower edge of the arm 56 and past the bottom surface 44 of the body 38, when the arm is suitably positioned. This is accomplished by adjustment of the screw 72, which is threadably engaged within a threaded bore 74 of the body 38 with its lower end bearing upon the surface of the contact element 60.

FIGS. 2–6 show a novel feature of the invention, constituted by an eccentric assembly utilized for adjustment of clearance on the bevel side of the trolley. More particularly, the assembly consists of a ball bearing subassembly, generally designated by the numeral 75, and a mounting stud generally designated by the numeral 82; an inner race 76, an outer race 78, and an array of ball bearings 80. Stud 82 is comprised of a shaft 84 having a slotted head 86 at one end, and including a collar portion 88, adjacent to the head 86, on which is mounted the ball bearing subassembly 75.

The body 38 of the head assembly 14 has a right-angle shoulder portion 90, on which the eccentric bearing assembly is disposed. For that purpose, a semicircular recess 92 is machined into one surface 94 of the shoulder portion 90, which surface is parallel to the longitudinal axis of the head, and a bore 96 extends normal thereto from the inner surface 98 of the recess 92. A threaded bore 100 extends into the right-angle surface 102 of the shoulder portion 90, in a direction normal thereto, to perpendicularly intersect the bore 96. The bore 100 receives a set screw 104, which serves to retain the stud 82 and, thereby, the roller bearing subassembly. For this purpose, the shaft 84 is formed with a circumferential groove 106, within which the tip of the screw 104 is engaged.

As will be appreciated, despite the locking function served by the screw 104 the stud 82 can be rotated without disassembly from the body 38. This permits adjustment of the angular orientation of the eccentric collar portion 88 with respect to the axis of the stud 82, and thereby the amount of projection of the wheel rim portion (provided by the outer race 78) beyond the lower surface 44. Thus, the eccentric assembly provides a highly effective means for establishing the desired spacing between the edge of the blade 108 and the edge 110 of the clamping bar body 32, as is highly important to the achievement of optimal results with a machine of the present type. Moreover, as will best be noted from FIG. 2, both the stud 82 and also the locking screw 104 are readily accessible, thus contributing to the convenience of making adjustments while the trolley is mounted on the rail 28, as is of course the most effective way of doing so.

A blade carrier is pivotably mounted (by means not shown) upon both of the side surfaces 54, 56 of the body 38, and each consists of an inner piece and an outer piece, 112, 114, respectively, secured in face-to-face contact by screws 116. Channel portions (not visible) are formed into the interior faces of the pieces 112, 114, and they cooperate to provide an enclosure or housing defining a blade magazine channel. Each carrier also includes a finger rest, or operating lever 118, and an operating knob 120. The lever 118 is retained in place between the pieces 112, 114 by the screws 116, which pass through aligned apertures therein, and the knob 120 has a threaded shaft by which it is mounted within a tapped aperture in the outer piece 114.

The two blade carriers serve to mount blade magazines, each generally designated by the numeral 122, which in turn hold cutting blades 108. The magazines consist of a pair of identical, generally rectangular plates joined in face-to-face contact, the plates having forward or leading end portions 124, and rearwardly disposed rectangular windows 126; distance scales may be embossed upon the upper and lower beveled edges of the windows 126. An adjustment screw 128 is engaged in a threaded passageway through the rear of the magazine, and the walls are spaced sufficiently from one another to permit the cutting blade 108 to be freely inserted from the leading end, with the adjustment screw 128 serving to limit the depth of insertion. It will be appreciated that the corners of the blade 108 project beyond the edges of the magazine plates, and that the extent of projection can be altered by advance and retraction of the screw 128, with the scales along the edges of the windows 126 permitting measured adjustments to be made, if so desired.

The magazines are mounted into the carriers by inserting them into channels defined between the pieces 112, 114, with internal structure serving to limit the depth of insertion so as to permit precise and facile repositioning. A locking screw 130 is tightened upon the inserted magazine, serving to lock it, as well as the blade 108, in position.

A lower production stop, generally designated by the numeral 132, is illustrated in FIG. 1, which serves to limit the travel of the trolley in that direction. It carries a clamping screw 134, which can be tightened upon the rail 28 to firmly lock the stop 132 in any desired position therealong; the body 38 of the cutting head assembly 14 mounts a stop assembly, generally designated by the numeral 136, which provides and an adjustable element for contacting the production stop 132. An upper production stop (not shown) will normally also be provided.

Although the manner in which the machine is employed will be evident to those skilled in the art, some description may nevertheless be in order. The clamping bar 34 is of course lifted away from the surface of the base 10 by elevation of the handle 22, and the piece or sheet 16 of mat board is placed thereupon and brought into proper position. The clamping bar 34 is then lowered upon the workpiece, and the head assembly 14 is moved outwardly along the rail 28 to a point beyond its upper edge. With the appropriate blade pivoted to its operative position, the trolley is run along the sheet to produce the cut, an underlying channel being provided in the base to receive the tip of the blade, as is conventional. A detent mechanism may be provided to assist in making long cuts, to minimize any difficulty that might be encountered in maintaining the pivoted condition of the carrier while simultaneously sliding the trolley along the rail.

The cutting head assembly of the invention affords a high degree of precision, coupled with a very free and smooth sliding action. These results are achieved by the cooperative effects of the bushings, disposed within the channel, and the two ball bearing wheel subassemblies, which most advantageously run on stainless steel glide strips attached to the upper surface of the clamping bar. It is of primary importance that the cutting blade on the bevel side be brought to a position closely adjacent the edge of the clamping bar, to cause the cut produced to conform as precisely as possible to the intended line. This is readily achieved by use of the adjustable eccentric wheel mechanism, as hereinabove described. In addition, it is highly advantageous that the bushings provide a close, free-sliding fit between the cutting head and the rail, independently of wheel subassembly adjustments.

Thus, it can be seen that the present invention provides a novel head assembly, and a novel mat cutting machine utilizing it, which is capable of smooth and reliable operation to produce cuts that are true and accurate, and precisely located on the workpiece. The position of the blade for bevel cutting can readily be adjusted and securely maintained once established, and such adjustments are readily made, with respect to the clamping bar and without removal of the cutting head from the machine.

Having thus described the invention, what is claimed is:

1. A head assembly for a mat cutting machine, comprising: a body having a bottom surface with at least one planar area thereon, a rectilinear channel extending from end-to-end through said body and opening on said bottom surface along the entire length thereof, a first surface portion along one side of said body disposed at an acute angle to said planar area and extending substantially parallel to the axis of said channel; a first wheel subassembly including a first wheel, and first means for mounting said first wheel on said body for rotation about an axis perpendicular to said channel axis, with at least a rim portion of said first wheel extending beyond said bottom surface at a location adjacent said one side of said body, said first mounting means including an axle member mounted for pivoting on an axis perpendicular to said channel axis, and locking means for securing said axle member in each of a multiplicity of angularly displaced positions pivoted on said axis of pivoting, said axle member having a support portion for supporting said first wheel for rotation about an eccentric axis parallel to said axis of pivoting and offset therefrom, the amount of such first wheel rim portion extension thereby being variable by pivoting of said axle member about said axis of pivoting, both said axle member and also said locking means being disposed on said body so as to permit ready access, for convenient manipulation thereof; and a second wheel subassembly, including a second wheel and second means for mounting said second wheel on said body for rotation about an axis perpendicular to said channel axis, with at least a rim portion of said second wheel extending beyond said bottom surface at a location spaced to the opposite side of said channel opening from said one side of said body, said second mounting means being adapted to permit variation of the amount of such second wheel rim portion extension.

2. The assembly of claim 1 wherein said axle member comprises an eccentric stud with a cylindrical shaft portion and a cylindrical collar portion adjacent one end of said shaft portion, the axes of said shaft and collar portions being parallel to and offset from one another, said collar portion providing said support portion of said axle member.

3. The assembly of claim 2 wherein said stud has inner and outer ends, said outer end having tool-engaging means thereon which is accessible to permit facile pivoting of said stud.

4. The assembly of claim 2 wherein said first wheel consists of a ball bearing comprised of two concentric ring components providing inner and outer races, the inner ring component being engaged upon said collar portion of said stud, and the outer ring component providing said rim portion of said first wheel.

5. The assembly of claim 2 wherein said shaft portion has a groove extending circumferentially thereabout at a location spaced from said one end, and wherein said locking means comprises a screw, said body having a threaded aperture in which said screw is threadably engaged, and said screw having a tip portion engaged within said groove of said shaft portion and being tight-enable thereupon to fix said stud against pivoting in said body.

6. The assembly of claim 5 wherein said body has a shoulder portion with adjacent faces disposed substantially perpendicular to one another, said shaft portion of said eccentric stud extending normal to one of said faces and said screw extending normal to the other face, said threaded aperture opening on said other face.

7. The assembly of claim 1 wherein said body has a second surface portion along the opposite side thereof extending substantially parallel to said axis of said channel and substantially perpendicular to said planar area, said second wheel being disposed adjacent said second surface portion.

8. The head assembly of claim 7 wherein said second means for mounting said second wheel comprises apivot arm pivotably supported upon said body and mounting said second wheel at a location spaced from the axis of pivotable support, and wherein said assembly additionally includes an adjustment element in effective engagement with said pivot arm for varying the angular orientation thereof about said support axis, and thereby the amount of second wheel rim portion extension beyond said bottom surface of said body.

9. The head assembly of claim 8 wherein said second wheel consists of a ball bearing comprised of two concentric ring components providing inner and outer races.

10. The head assembly of claim 1 additionally including a pair of bushing elements fabricated from a low-friction bearing material and disposed within said body channel adjacent the opposite ends thereof, to provide spaced bearing surfaces thereat.

11. The head assembly of claim 10 wherein each of said bushing elements is fabricated from a synthetic resinous material and is a ring-like structure forming less than a complete circle, and wherein clearance-adjustment means, overlying said bushing elements, is provided for applying upward force upon said body so as to effect tightening thereof against said bushing elements and, in turn, against a mounting rail.

12. The assembly of claim 1 additionally including blade mounting means on said first surface portion, said blade mounting means being adapted to mount a cutting blade in a plane substantially parallel to said first surface portion and outwardly of said first wheel.

13. A head assembly for a mat cutting machine, comprising: a body having a bottom surface with at least one planar area thereon, a rectilinear channel extending from end-to-end through said body and opening on said bottom surface along the entire length thereof, a first surface portion along one side of said body disposed at an acute angle to said planar area and extending substantially parallel to the axis of said channel; a first wheel subassembly including a first wheel, and first means for mounting said first wheel on said body for rotation about an axis perpendicular to said channel axis, with at least a rim portion of said first wheel extending beyond said bottom surface at a location adjacent said one side of said body, said first mounting means including an axle member mounted for pivoting on an axis perpendicular to said channel axis, and locking means for securing said axle member in each of a multiplicity of angularly displaced positions pivoted on said axis of pivoting, said axle member having a support portion for supporting said first wheel for rotation about an eccentric axis parallel to said axis of pivoting and offset therefrom, the amount of such first wheel rim portion extension thereby being variable by pivoting of said axle member about said axis of pivoting, both said axle member and also said locking means being disposed on said body so as to permit ready access, for convenient manipulation thereof; and contact means, disposed at a location spaced to the opposite side of said channel opening from said one side of said body, for engagement of underlying structure to support said body for slidable movement therealong.

14. The assembly of claim 13 wherein said axle member comprises an eccentric stud with a cylindrical shaft portion and a cylindrical collar portion adjacent one end of said shaft portion, the axes of said shaft and collar portions being parallel to and offset from one another, said collar portion providing said support portion of said axle member; and wherein said first wheel consists of a ball bearing comprised of two concentric ring components providing inner and outer races, the inner ring component being engaged upon said collar portion of said stud, and the outer ring component providing said rim portion of said first wheel.

15. The assembly of claim 14 wherein said shaft portion has a groove extending circumferentially thereabout at a location spaced from said one end; wherein said locking means comprises a screw, said body having a threaded aperture in which said screw is threadably engaged, and said screw having a tip portion engaged within said groove of said shaft portion and being tightenable thereupon to fix said stud against pivoting in said body; and wherein said body has a shoulder portion with adjacent faces disposed substantially perpendicular to one another, said shaft portion of said eccentric stud extending normal to one of said faces and said screw extending normal to the other face, said threaded aperture opening on said other face.

16. In a mat cutting machine, the combination comprising:

a base having an upper, mat-supporting surface;

a handle assembly pivotably mounted upon said base for movement between a position overlying said mat-supporting surface of said base, and a position displaced therefrom;

a clamping bar assembly pivotably mounted by said handle assembly and including an elongated clamping bar and a substantially coextensive guide rail, said clamping bar having substantially planar top and bottom surface portions extending along the length thereof, and being adapted to rest with said bottom surface disposed substantially upon said upper surface of said base with said handle assembly in said overlying position thereof, said guide rail being affixed on top of said clamping bar and being adapted to slidably mount a cutting head assembly for movement therealong; and a head assembly comprising: a body having a bottom surface with at least one planar area thereon, a rectilinear channel extending from end-to-end through said body and opening on said bottom surface along the entire length thereof, a first surface portion along one side of said body disposed at an acute angle to said planar area and extending substantially parallel to the axis of said channel; a first wheel subassembly including a first wheel, and first means for mounting said first wheel on said body for rotation about an axis perpendicular to said channel axis, with at least a rim portion of said first wheel extending beyond said bottom surface at a location adjacent said one side of said body, said first mounting means including an axis member mounted for pivoting on an axis perpendicular to said channel axis, and locking means for securing said axle member in each of a multiplicity of angularly displaced positions pivoted on said axis of pivoting, said axle member having a support portion for supporting said first wheel for rotation about an eccentric axis parallel to said axis of pivoting and offset therefrom, the amount of such first wheel rim portion extension thereby being variable by pivoting of said axle member about said axis of pivoting, both said axle member and also said locking means being disposed on said body so as to permit ready access, for convenient manipulation thereof; and a second wheel subassembly, including a second wheel and second means for mounting said second wheel on said body for rotation about an axis perpendicular to said channel axis, with at least a rim portion of said second wheel extending beyond said bottom surface at a location spaced to the opposite side of said channel opening from said one side of said body, said second mounting means being adapted to permit variation of the amount of such second wheel rim portion extension, said head assembly being slidably mounted upon said clamping bar with said guide rail extending through said channel of said body thereof, and with said first and second wheels both bearing upon said top surface portions of said clamping bar to cooperate in supporting said head assembly during movement therealong, and providing the only contact of said head assembly thereupon, said head assembly including blade mounting means on said first surface portion thereof, said blade mounting means being adapted to mount a cutting blade in a plane substantially parallel to said first surface portion of said body and outwardly of said first wheel.

17. The machine of claim 16 wherein said axle member comprises an eccentric stud with a cylindrical shaft portion and a cylindrical collar portion adjacent one end of said shaft portion, the axes of said shaft and collar portions being parallel and eccentric to one another, said collar portion providing said supporting portion of said axle member; and wherein said first wheel consists of a ball bearing comprised of two concentric ring components providing inner and outer races, the inner ring component being engaged upon said collar portion of said stud, and the outer ring component providing said rim portion of said first wheel.

18. The machine of claim 17 wherein said body has a shoulder portion with adjacent faces disposed substantially perpendicular to one another, wherein said shaft portion of said eccentric stud extends normal to one of said faces, and has a groove extending circumferentially thereabout at a location spaced from said one end, and wherein said locking means comprises a screw and said body has a threaded aperture, extending normal to the other face of said body shoulder portion and opening thereon, in which said screw is threadably engaged, said screw having a tip portion engaged within said groove of said shaft portion and being tightenable thereupon to fix said stud against pivoting in said body.

19. The machine of claim 17 wherein said head assembly additionally includes a pair of bushing elements fabricated from a low-friction synthetic resinous bearing material and disposed within said body channel and adjacent the opposite ends thereof, to provide spaced bearing surfaces thereat conforming to the circumference of said rail, said rail extending through said bushings to slidably mount said head assembly thereon.

* * * * *

UNITED STATES PATENT AND TRADEMARK OFFICE

CERTIFICATE OF CORRECTION

PATENT NO. : 4,798,112

DATED : January 17, 1989

INVENTOR(S) : Vincent T. Kozyrski and Alan R. Peters

It is certified that error appears in the above-identified patent and that said Letters Patent is hereby corrected as shown below:

Claim 16, line 25 (column 10), delete the word "axis" and substitute therefor --axle--.

Claim 19, line 9 (column 12), delete the word "and". (2nd occurrence)

Signed and Sealed this

Sixteenth Day of May, 1989

*Attest:*

DONALD J. QUIGG

*Attesting Officer*

*Commissioner of Patents and Trademarks*